US008288957B2

(12) United States Patent
Willaert

(10) Patent No.: US 8,288,957 B2
(45) Date of Patent: Oct. 16, 2012

(54) SYSTEM FOR CONTROLLING LIGHT SOURCES

(75) Inventor: Wouter Lambertus Petrus Willaert, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 373 days.

(21) Appl. No.: 12/598,098

(22) PCT Filed: Apr. 28, 2008

(86) PCT No.: PCT/IB2008/051625

§ 371 (c)(1),
(2), (4) Date: Oct. 29, 2009

(87) PCT Pub. No.: WO2008/135895

PCT Pub. Date: Nov. 13, 2008

(65) Prior Publication Data

US 2010/0134042 A1 Jun. 3, 2010

(30) Foreign Application Priority Data

May 3, 2007 (EP) ..... 07107416

(51) Int. Cl.
*G05F 1/00* (2006.01)

(52) U.S. Cl. ..... 315/291; 315/307; 315/312; 315/224

(58) Field of Classification Search ..... 315/291, 315/307, 312–326, 224, 225
See application file for complete search history.

(56) References Cited

U.S. PATENT DOCUMENTS

| | | | |
|---|---|---|---|
| 4,200,862 | A | 4/1980 | Campbell et al. |
| 4,659,941 | A | 4/1987 | Quiros et al. |
| 5,598,039 | A | 1/1997 | Weber |
| 5,818,128 | A | 10/1998 | Hoffman et al. |
| RE38,069 | E | 4/2003 | Posa |
| 2006/0292924 | A1 | 12/2006 | Spiri et al. |

FOREIGN PATENT DOCUMENTS

| | | | |
|---|---|---|---|
| WO | 2004023849 | A1 | 3/2004 |

*Primary Examiner* — Tuyet Thi Vo
(74) *Attorney, Agent, or Firm* — Mark L. Beloborodov

(57) ABSTRACT

A lighting control system (100) includes a first adapter (150) configured to be operationally coupled to a first light source (110) to provide a first power level, and a second adapter (160) configured to be operationally coupled to a second light source (120) to provide a second power level. A controller (170) is configured to control the first adapter (150) to change the first power level to a current power level. The first adapter (150) is further configured to detect the changed or current (absolute or relative) power level so that the second adapter (160) is controlled, e.g., by first adapter (150), based on the detected current power level.

4 Claims, 1 Drawing Sheet

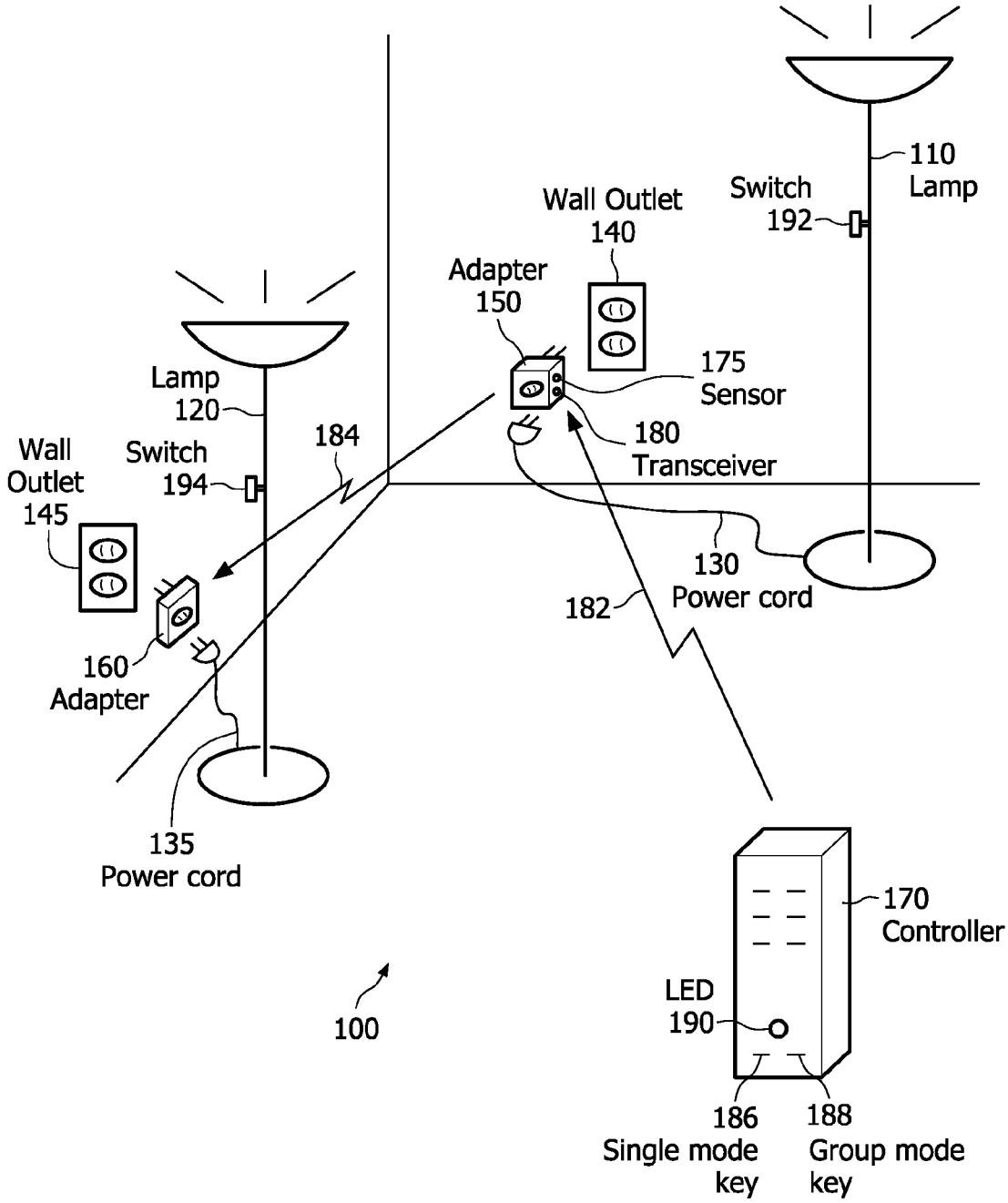
110
Lamp
Switch
192
Wall Outlet
140
Adapter
150
175
Sensor
180
Transceiver
Lamp
120
184
Wall
Outlet
145
Switch
194
130
Power cord
182
160
Adapter
135
Power cord
170
Controller
LED
190
100
186
Single mode
key
188
Group mode
key

SYSTEM FOR CONTROLLING LIGHT SOURCES

The system relates to a lighting control system including intelligent adapters configured to sense the current power level of a first light source, and controlling a second light source based on the detected current power level of the first light source.

Currently, home light control systems are being installed at homes either by the consumer or by a professional installer. These home light networks and control systems vary in complexity depending on the type of installed system. The complexity of these systems grows with the number of nodes which are part of the system. Further, system complexity is increased with increased number and complexity of system parts. For example, control devices are introduced with a high level of complexity, both during installation as well as during normal use. Typical solutions for reducing complexity are simple control systems that may include an LCD screen, for lighting control through soft menus, for example.

The disadvantage of most systems is that the original light control system is bypassed by the new system instead of being integrated with the new system. Often, the pre-existing light switches become a burden in a new system, yet consumers still want to be able to use both the new system and the old system to control the lighting system. In other words, consumers want to be able to control the light system by using either the existing light switches or a newly introduced control device without the systems interfering or conflicting with each other.

What is lacking is a lighting control system that allows a user to control in a simple manner a lighting system that includes multiple light sources to produce a desired overall illumination and/or light effect.

One object of the present systems and methods is to overcome the disadvantages of conventional lighting control systems.

According to illustrative embodiments, a lighting control system includes a first adapter configured to be operationally coupled to a first light source to provide a first power level, and a second adapter configured to be operationally coupled to a second light source to provide a second power level. A controller is configured to control the first adapter to change the first power level to a current power level. The first adapter is further configured to detect the changed or current (absolute or relative) power level so that the second adapter is controlled, e.g., by the first adapter and/or by the controller, based on the detected current power level.

Further areas of applicability of the present systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus, systems and methods of the present invention will become better understood from the following description, appended claims, and accompanying drawing where:

FIG. 1 shows an interactive system according to an illustrative embodiment of the present system.

The following description of certain exemplary embodiments is merely exemplary in nature and is in no way intended to limit the invention, its applications, or uses. In the following detailed description of embodiments of the present systems and methods, reference is made to the accompanying drawing which forms a part hereof, and in which is shown by way of illustration a specific embodiment in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. For the purpose of clarity, detailed descriptions of well-known devices, circuits, and methods are omitted so as not to obscure the description of the present system.

The present systems and methods provide the possibility to use all kinds of existing light switches as an input device for the whole system without major modifications and cost. The way this may be done is to use as much of the electronics and components which are already used to control the light node to measure the absolute and relative power consumption. The current level and changes of power, voltage, and/or current consumption are used in deciding on scene settings in the room. Thus, the problem of existing switches is translated into an advantage, since existing lighting systems are used and integrated with the present systems and methods. It should be understood that, for simplicity, power (and power consumption) will be referred to include at least one of power, voltage and current (consumption).

FIG. 1 shows an embodiment of a lighting interaction or control system 100 where at least two light sources 110, 120 are shown. Each light source 110, 120 has a power cord 130, 135 to receive power from a mains power source, such as wall outlets 140, 145, respectively, to provide 120VAC, 60 Hz, for example. The control system 100 includes a first adapter 150 configured to be operationally coupled to the first light source 110 to provide a first power level to the first light source 110, and a second adapter 160 configured to be operationally coupled to the second light source 120 to provide a second power level to the second light source 120. Illustratively, the first light source 110 may be plugged into the first adapter 150 which is in turn plugged into the first wall outlet 140, and the second light source 120 may be plugged into the second adapter 160 which is in turn plugged into the second wall outlet 145.

The control system 100 further includes a controller 170, such as a remote controller, configured to control the first adapter 150 to change the first power level (provided to the first lamp 110) to a changed or current power level, similar to a conventional remote controller that controls conventional power adapters where the first lamp 110 may be turned on or off, or its light output intensity changed, such as dimmed.

By contrast to conventional control systems, where conventional adapters are merely just actuators (to turn on/off and dim lights) and do not includes sensors or switches, at least one of the adaptors 150, 160 of the present control system 100 is intelligent and includes a sensor 175 to measure the current power level, in relative or absolute terms. In the case where the first adaptor 150 includes the sensor 175 then, in a group or linked mode, upon detecting the current power level, the first adaptor 150 includes a transceiver 180 to communicate this measured value of the current power provided or consumed by the first lamp 110 to the second adaptor 160 for controlling the second lamp 120, e.g., changing the power level provided to the second lamp 120, based on the detected or measured current power level.

For example, the transceiver 180 receives a control signal 182 from the remote controller 170, changes the power level of the first lamp 110 in response to the control signal. The sensor 175 measures the changed current power level of the first lamp 110, and the transceiver 180 transmits to the second (slave) adaptor 160 of second lamp 120 an adapter control signal 184 including the changed current power level. In response to the adapter control signal 184, the second (slave) adaptor 160 controls the power provided to the second lamp 120, which may be equal to the changed current power level of the first lamp 110, for example.

Illustratively, the first adaptor 150 controls the second adaptor to change the power level of the second lamp 120 to the current power level of the first lamp 110. Thus, the second adaptor 160 is controlled in response to receipt of the current power level of the first lamp 110 from the first adaptor 150, or from the controller 170 in which case the first adaptor 150 provides the current power level of the first lamp 110 to the controller 170 for controlling the second lamp 120 based on the current power level of the first lamp 110.

As is well known, the remote controller 170 may have buttons to control at least one of the light sources or lamps 110, 120. For example, such buttons or keys may include an ON/OFF button, and UP and DOWN buttons to change the intensity of light emanating from the first lamp 110, by controlling the first adapter 150 to change the power provided to the first lamp 110. Of course, other types of user buttons or interfaces may be provided, such as rotary or slidable knobs, or remote controls with touch screen where soft keys, button, and/or rotary or slidable knobs are displayed on the screen and control by any input device, such as a pointer, mouse, keyboard and the like.

The remote controller 170 may further include one or more mode buttons to change the mode of the control system 100 from a single or normal mode to a group or linked mode. For example, one mode button may be provided to toggle between the normal and group mode, where an indication such as a light, e.g., light emitting diode (LED), indicates the mode, where the LED may be off in the normal mode and on in the group mode. Instead of a single button, the controller 170 may include two buttons 186, 188 as shown in FIG. 1, where one button 186 places the system 100 in the normal mode and the other button 188 places the system in the group mode. One or more LEDs 190 may provide an indication of the mode of operation.

In the normal mode, the remote controller controls the adapter(s) associated with the remote controller (which acts as the master) and the adapters themselves acts as slaves. In the group mode, one of the adapters such as the first adapter 150 receives the control signal 182 from the remote controller 170, measures the current power provided or consumed by the first lamp 110, changes the power provided to the first lamp 110 in accordance with or in response to the control signal 182. Further, the first adapter 150 transmits the adapter control signal 184 to the other conventional or intelligent adapters, such as the second intelligent adapter 160 for changing the power provided to the second lamp source 120.

In response to the adapter control signal 184, the second intelligent adapter 160 changes the power provided to the second lamp 120 similar to changing the power provided to the first lamp 110 by the first adapter 150 (in response to the control signal 182 from the remote controller 170). That is, the second intelligent adapter 160 measures the current power provided or consumed by the second lamp 120, and changes the power provided to the second lamp 120 in accordance with or in response to the adapter control signal 184. Thus, a group of lights may be controlled to provide light of desired intensity when the user activates the remote controller 170.

Desired lamps or light sources may be linked together, such as manually by the user through the remote controller 170 or any other user interface, such as having various input/output devices, such as keyboard, screens which may be touch sensitive, pointers, mouse, etc. Alternatively, grouping or linking various lamps may be performed through the intelligent adapters that provide power to the lamps, e.g., via toggle switches (e.g., 4 toggle switches) on the adapters, where toggle switches of all the adapters linked together are set identically or similarly, e.g., the first three toggle switches of all the linked or grouped adapters are off while the last toggle switch is on.

The changed power levels may be in absolute or relative terms. For example, the control signal 182 from the remote controller 170 and/or the adapter control signal 184 from the master adapter 150 may include an absolute power level, such as 40% relative to zero, or may include a change (increase or decrease) of power from the current power level consumed or provided to the controlled lamp, such as to change the lamp power by 30% more or less than the current lamp power level.

Communication among the various elements such as among the remote controller 170, and the two adaptors 150, 160 may be by any means, wired or wireless, using any protocol, such as the ZigBee™ protocol, for example. It should also be understood that the adaptors 150, 160 may be integrated in the lamps 110, 120, respectively, or integrated with the wall outlets 140, 145, or integrated with other elements such as wall and/or ceilings or rooms, instead of being separate stand-alone elements.

In another embodiment of the system the lamps may also include control switches, such as an on/off and dimmer switch 192 of the first lamp 110 and a similar lamp switch 194 of the second lamp 120. The power adapters 150, 160 sense what the user does with the lamp switches 192, 194 and measure the power provided or consumed by each lamp 110, 120. By contrast to the intelligent adapters 150, 160 of the present control system 100, in conventional control systems, it would be a problem if a user starts controlling, e.g., dimming a light source or lamp via the lamp switch, for example, if the same light source is also dimmable via a conventional remote control and adapter system, because the conventional adapter does not sense or know the current power level of the lamp.

The intelligent adapters 150, 160 of the present control system 100 are configured to sense the power consumption of the light sources. For example, the first few instances the first light source 110 is on, the first intelligent adapter 150 may learn what power levels exist or are provided and/or consumed by the first lamp 110 (i.e., absolute levels).

As an illustrative example, when the first light source 110 is off, if a signal is sent from the remote controller 170 (or from the second adaptor 160 acting as a master) to the first adapter 150 to turn the first light source 110 to one-half power, then the first light source 110 will output one-half power (0 power+½ power=½ power). However, if the first light source 110 has been turned, for example, to one-quarter power (¼ power) manually via its lamp switch 192 and the first adapter 150 receives the same signal to produce half power (½ power), then the first adapter 150 will sense the current or pre-existing power level the first light source 110 and increase the lamp power by only ¼, since ¼ power+¼ power=½ power. In other words, the first adapter 150 is "intelligent" in that it senses the existing power level of the first light source 110 and adjusts the signal accordingly to compensate for the difference to produce the proper power level.

The light sources, lamps or luminaires of the present systems and methods may be made part of a group of light sources or luminaires which may have a more or less cloned behavior, for example, 4 uplighters or torch lamps one in each corner of a room where two lamps 110, 120 are shown in FIG. 1. An intelligent adapter, such as the first adapter 150 will not only change, e.g., dim the first light source itself (which is associates with first adapter 150, such as plugged into the first adapter 150), but also will control the other cloned or grouped light sources, such as dim the second lamp 120 to a level associated with or equal to the dimming level of the first light source 110, using absolute and/or relative power levels or changes.

Predetermined relationships may exist among the light sources such as when the first light source is dimmed to or by 50% power, then the second light source will be dimmed to or by a fraction of 50%, such as by 40% or 70% and the like. Of course, in the case where the power changes are relative levels, instead of absolute levels, then if first lamp 110 is already on at 70% power and the second lamp 120 is already on at 60% power, and the remote controller signal 182 (and/or the adapter signal 184) indicates relative dimming by half or 50%, then the first adapter provides 35% to the first lamp 110 (i.e., half of 70%), and the second adapter provides 30% power to the second lamp 120 (i.e., half of 60%).

Thus, changing the power level of one lamp by the remote controller also changes the power level of the cloned lamps by a commensurate amount or value, which is transmitted by the master adapter to the slave adapters in the group. The effect will be a master-slave relation between the different luminaires in the group. Switching all the lights on/off by the system may also be possible.

Of course, the two adapters 150, 160 may be identical having respective sensors and transceivers, where the second adaptor 160 may act as the master, and the first adaptor 150 acts as the slave, in the case where the remote controller 170, or a further controller, initially communicates with the second adaptor 160 to change the power level of the second lamp 120. Similar to the situation the first adaptor 150 is the master, in response to a signal from the controller, the second adapter 160 measures the current power provided to or consumed by the second lamp 120, changes the power level in accordance with the signal from the controller, and communicates the changed power level (relative or absolute) to the first adaptor 150 for control or change of the power provided to the first lamp 110; where the sensor 175 of first adaptor 150 measures the existing power provided to or consumed by the first lamp 110 and, based on the measured power and the signal received from the second adaptor 160, the first adaptor 150 changes the power provided to the first lamp 110.

A master-slave light system is shown in U.S. Pat. No. 5,598,039 to Weber and assigned to U.S. Philips Corporation, which is incorporated herein by reference in its entirety, and describes a master slave switch system which comprises a main lamp and a secondary lamp. When the main lamp is turned on or turned off, a distinctive wireless signal is sent to the remote slave electrical system. By means of this signal, the slave electrical system is turned off when the main electrical system is turned off and the slave electrical system is turned on when the main electrical system is turned on.

The slave light sources may be configured to imitate the actions of a master light source. Or they may be configured to follow the master light source in a delaying fashion. For example, when the master dims, the slave light sources may dim after a preset amount of time. Further, the slave light sources may dim in a specified order or the slaves may dim based on the relative proximity location of the slave light sources to the master light source. Another embodiment may be that the slave light sources dim based on their position in the room or occupied space.

It should also be understood that the remote controller is not needed, and a change of the power level via a lamp controller, such as the first lamp controller 192, may be detected by the first adapter 150, which measures the changed or current power provided or consumed by the first lamp 110 and transmits the adapter signal 184 to the other linked or cloned adapters to change the power of the cloned lamps as described, based on absolute or relative values, such as to change the power of the cloned lamps in proportions to the change in power level of the first lamp 110 (i.e., relative power levels), or to change the power of the cloned lamps to be the same as, or a predetermined proportion of, the power to the first lamp (i.e., and absolute levels). Accordingly, consumers may control their lights in a more natural way since they are already used to control lights on the light source. Often, the luminaries are closer to the user than the remote controller since remote controller tends to be moved in the room by users.

Although two adapters and two light sources are described in the illustrative embodiments, it should be understood that as many light sources and adapters may be used where, for example, one or more adapters may act as the master(s), and the remaining one or more adapters may act as slave(s). The light sources may be configured with one master light source and the remaining luminaires being slaves to the master luminaire. The light sources may also be configured so that they are slaves to the adapter and/or adapters. Each light source may have its own adapter, or a set of light sources may be served by one adapter or multiple adapters. In one embodiment, simply sending a command signal to one light source (via remote control 170 or a lamp dimmer 192, 194, for example) may dim the entire set of cloned, linked or grouped light sources. This makes for a lighting control system that is easier to manage.

The controller 170 and/or the intelligent adaptors 150, 160 may also be configured to control the light sources to produce other light effects based on their location in the room. In other word, the lights may increase and decrease output in a certain pattern that is pleasing to the consumer/user. Control signals that may be determined by the adapter or lighting control system the lighting devices comprise absolute power level, maximum level, minimum level, dim up, dim down, on and off The controller 170 and/or the intelligent adaptors 150, 160 may each have their own processor and memory to store and executes programs concerning control of the light sources. These light sources so equipped may learn the usual patterns of lighting in an area or house. For example, the lighting in an office may typically start at a certain hour (start of the work day) and lights may go out at a later time (end of work day). Then, the light source processor and memory may learn the regular times of turning off and on and the adapters may create that program of light settings that create that light pattern automatically without any further input by the user. The light source sets may be configured to handle other type of behavior besides group control/cloning such as scene setting or an all on/off setting.

It should be understood that the various components of the interactive lighting control system 100 may be interconnected through a bus, for example, or operationally coupled to each other by any type of link, including wired or wireless link(s), for example. Further, various input devices may be used in addition or instead of the remote controller 170, such as touch sensitive displays, keyboard, mouse, etc. Thus, the user may select predetermined scenarios from tables or menus displayed on any associated display.

Of course, as it would be apparent to one skilled in the art of communication in view of the present description, various elements may be included in the system or network components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor. As is well-known, the controller 170 and/or the adaptors 150, 160 may include processors configured to execute instructions stored in a memory thereof, for example, which may also store other data, such as predetermined or programmable settings related to system control.

Various modifications may also be provided as recognized by those skilled in the art in view of the description herein. The operation acts of the present methods are particularly suited to be carried out by a computer software program and/or scripts. The computer software program, for example, may contain modules corresponding to the individual steps or acts of the methods. The application data and other data are received by the controller or processor for configuring it to perform operation acts in accordance with the present systems and methods. Such software, application data as well as other data may of course be embodied in a computer-readable medium, such as an integrated chip, a peripheral device or memory, such as the memory or other memory coupled to the processor of the controller or light module.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory.

Additional memories may also be used. The computer-readable medium, the memory, and/or any other memories may be long-term, short-term, or a combination of long-and-short term memories. These memories configure the processor/controller and/or the intelligent adaptors to implement the methods, operational acts, and functions disclosed herein. The memories may be singularly located with the processor or distributed through the system, where additional processors may be provided which may be distributed or singular. The memories may be implemented as electrical, magnetic or optical memories, or any combination of these or other types of storage devices. Moreover, the term "memory" should be construed broadly enough to encompass any information able to be read from or written to an address in the addressable space accessed by a processor. With this definition, information on a network, such as the Internet, is still within or part of the memory, for instance, because the processor may retrieve the information from the network.

The adapter/processor and the memories may be any type of processor/controller and memory. The processor may be capable of performing the various described operations and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for identifying the presence and identity of the user may be utilized in conjunction with further systems.

Of course, it is to be appreciated that any one of the above embodiments or processes may be combined with one or with one or more other embodiments or processes to provide even further improvements in lighting control.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference signs in the claims do not limit their scope;
d) several "means" may be represented by the same or different item or hardware or software implemented structure or function;
e) any of the disclosed elements may be comprised of hardware portions (e.g., including discrete and integrated electronic circuitry), software portions (e.g., computer programming), and any combination thereof;
f) hardware portions may be comprised of one or both of analog and digital portions;
g) any of the disclosed devices or portions thereof may be combined together or separated into further portions unless specifically stated otherwise; and
h) no specific sequence of acts or steps is intended to be required unless specifically indicated.

The invention claimed is:

1. A lighting control system comprising:

a first adapter operationally coupled to a first light source to provide a first power level, wherein the first light source is controllable via a switch;

a second adapter operationally coupled to a second light source to provide a second power level; and a remote controller configured to control the first adapter to change the first power level of the first light source to a current power level;

wherein the first adapter is configured to detect the current power level of the first light source so that the second power level is controlled based on the detected current power level of the first light source.

2. The lighting control system of claim 1, wherein the first adapter is further configured to communicate the detected current power level to the second adapter to change the second power level to the detected current power level.

3. The lighting control system of claim 1, wherein the second adapter is a slave and the first adapter is a master configured to control the slave.

4. The lighting control system of claim 1, wherein the first adapter includes a sensor configured to measure the current power level.

* * * * *